US006188983B1

(12) United States Patent
Hanson

(10) Patent No.: US 6,188,983 B1
(45) Date of Patent: Feb. 13, 2001

(54) METHOD FOR DYNAMICALLY ALTERING TEXT-TO-SPEECH (TTS) ATTRIBUTES OF A TTS ENGINE NOT INHERENTLY CAPABLE OF DYNAMIC ATTRIBUTE ALTERATION

(75) Inventor: Gary Robert Hanson, Palm Beach Gardens, FL (US)

(73) Assignee: International Business Machines Corp., Armonk, NY (US)

( * ) Notice: Under 35 U.S.C. 154(b), the term of this patent shall be extended for 0 days.

(21) Appl. No.: 09/145,781

(22) Filed: Sep. 2, 1998

(51) Int. Cl.[7] ..... G10L 13/08
(52) U.S. Cl. ..... 704/260; 704/270
(58) Field of Search ..... 704/260, 270

(56) References Cited

U.S. PATENT DOCUMENTS 5,384,893 * 1/1995 Hutchins ..... 704/267
5,689,618 * 11/1997 Gasper et al. ..... 704/270
5,796,916 * 8/1998 Meredith ..... 704/258
5,799,273 * 8/1998 Mitchell et al. ..... 704/235
5,850,629 * 12/1998 Holm et al. ..... 704/260
5,878,393 * 3/1999 Hata et al. ..... 704/260
5,884,263 * 3/1999 Aaron et al. ..... 704/270
5,924,068 * 7/1999 Richard et al. ..... 704/260
5,933,805 * 8/1999 Boss et al. ..... 704/249
5,960,447 * 9/1999 Holt et al. ..... 704/500

* cited by examiner

*Primary Examiner*—Krista Zele
*Assistant Examiner*—Michael N. Opsasnick
(74) *Attorney, Agent, or Firm*—Quarles & Brady LLP

(57) ABSTRACT

In a TTS system external to a TTS engine, a method for dynamically altering text-to-speech (TTS) attributes of a TTS engine not inherently capable of dynamic attribute alteration is disclosed. The method of the invention can include several steps beginning with the step of representing in the external system a resettable start word position value by a first variable. Second, a current word position offset value can be represented in the external system by a second variable. Third, the second variable can be updated in the external system each time a word of the specified text is played back. Fourth, the TTS playback can be stopped in response to a user request to alter the TTS attribute. Fifth, after stopping the TTS playback, the TTS engine attribute can be altered. Also, after stopping the TTS playback, the first variable can be replaced in the external system with a new start word position value corresponding to the next successive unplayed word of the specified text. Finally, playback of the text can be restarted in accordance with the new word start position value to play back the next successive unplayed word.

10 Claims, 5 Drawing Sheets

METHOD FOR DYNAMICALLY ALTERING TEXT-TO-SPEECH (TTS) ATTRIBUTES OF A TTS ENGINE NOT INHERENTLY CAPABLE OF DYNAMIC ATTRIBUTE ALTERATION

BACKGROUND OF THE INVENTION

1. Field of the Invention

This invention relates generally to text-to-speech (TTS) engines, and in particular, to dynamic alteration of TTS attributes during TTS playback.

2. Description of Related Art

One of the current deficiencies in many text-to-speech products is the inability to dynamically alter various attributes of text-to-speech (TTS) playback, such as pitch and speed, while playback is in progress. However, users need the ability to adjust various parameters of text-to-speech playback such as pitch and speed. Some users need to make these adjustments simply for aesthetic reasons; others for practical reasons. For example, as a user becomes more accustomed to the sound of synthesized speech comprehension typically increases. Consequently, the user may wish the TTS system to read the text faster as time goes by. Most TTS products provide for adjustment of such parameters, but only within special input windows or panels. Most often, these TTS products preclude the ability to make these adjustments while playback is in progress. This deficiency can be a burden when the user is attempting to make compromises between multiple parametric adjustments such as pitch, tone, speed and emotive content. Different combinations will sound better than others to the ear of a particular user, but the search for the best combination is made laborious by the need to continually stop playback, adjust one or more parameters and resume playback. A long-felt need exists for an improved method for adjusting TTS parameters while playback is in progress.

SUMMARY OF THE INVENTION

The solution to this long-felt need lies in programmatically stopping playback, adjusting the parameters and resuming playback in a way that is hidden from the user and which appears to occur automatically and without disruption

DETAILED DESCRIPTION OF THE PREFERRED EMBODIMENTS

Figure 1:
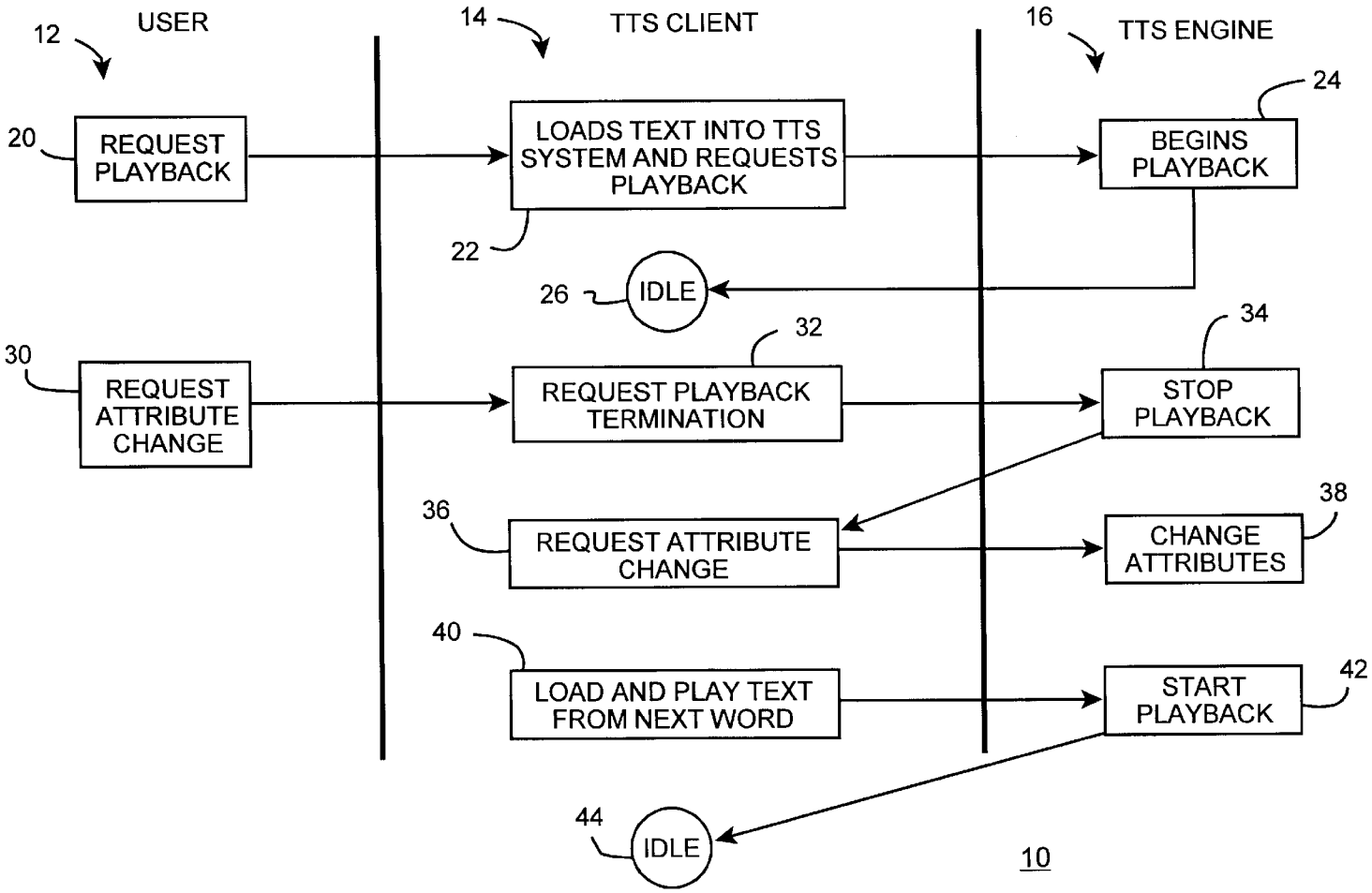
FIG. 1 is a flow chart useful for explaining the general program flow between a user, a TTS client and a TTS engine for TTS playback within a speech application.

In order to provide a working context for the inventive arrangements taught herein it is useful to make certain assumptions about the kind of text-to-speech (TTS) engine which is typical of the prior art and with which the inventive arrangements are most appropriate. Accordingly, it has been assumed that: (1) the TTS engine does not inherently allow dynamic adjustment of attributes; (2) the TTS engine provides a programmatic means for loading text for the purposes of playback and for starting and stopping playback; (3) the TTS engine provides a programmatic means for adjusting attributes; (4) the TTS engine notifies a client application of the position of the word currently playing, such notifications being referred to as WordPosition callbacks; and, (5)the TTS engine notifies a client application when all of the text provided to the TTS system has been played, such notifications being referred to as AudioDone callbacks.

General Flow

Implementation of the inventive arrangements further requires: a TTS system or engine; a TTS client application using the inventive arrangements in concert with the TTS engine; and, a user who controls the client application via any number of mechanisms available with the current state of the art. With regard to implementation of the inventive arrangements, the primary purposes of the client application are to: (1) display text to the user or provide a mechanism for textual input by the user or both, this function being a typical software function and accordingly not described in detail; (2) enable the user to specify, either by default or through specific actions, a range of text for the TTS engine to play, this function also being a standard software function not described in detail; (3) preprocess the text and any other data prior to initiating TTS playback; (4) handle notifications from the TTS engine and possibly, but not necessarily, display each word simultaneously with its TTS playback; and, (5) enable the user to adjust various TTS attributes including, but not limited to, pitch speed, emotive content and tone.

For purposes of convenience, it is further assumed that the user has provided the TTS client with a range of text to play through any standard mechanism prior to initiating playback. Finally, it is assumed that the TTS system has been initialized in any fashion as specified by the TTS system manufacturer. The details of initialization are unique to each system and need not be described herein.

A number of program global variables are defined in accordance with the inventive arrangements, to which reference is made in the description and drawings. These global variables are defined in Table 1.

TABLE 1

| Variable | Type | Description |
|---|---|---|
| gText | Text string | Original text string provided by user. |
| gActualstart | Number | The starting offset, relative to gText, of the text string currently loaded in the TTS system. Set to 0 when gText is initially loaded. |
| gCurrentPos | Number | The offset of the word currently playing in the TTS System. Set to 0 when gText is initially loaded |
| gTTSCurOffset | Number | The latest offset returned by the TTS system via the WordPosition notification. |
| GAttributes | TTS engine defined | This variable functions as a catch-all for any number of attribute values whose type and ranges vary from manufacture to manufacturer. For instance, there could be separate variables for pitch and speed. Within this disclosure, attributes will be used to refer to all of the attribute values as one body. |

FIG. 1 is a flow chart 10 showing the general program flow for TTS playback in accordance with the inventive arrangements. The flow chart is divided into three different areas 12, 14 and 16 representing the user, the TTS client and the TTS engine respectively. The user requests playback in area 12 in accordance with the step of block 12, for example by pressing a button, selecting a menu item or uttering a voice command. The TTS client in area 14 accepts that request and directs the TTS system to begin playing the data, in accordance with the step of block 14. In area 16, the TTS engine begins playback in accordance with the step of block 24, responsive to the TTS client request. In the meantime, the TTS client enters an idle state in accordance with the step of block 26, awaiting either further user input or notifications from the TTS engine.

FIG. 1 also shows the high level program flow for handling an attribute change while the TTS engine is playing. The user requests an attribute change in accordance with the step of block 30. The TTS client requests termination of playback in accordance with the step of block 32, and the TTS engine stops playback in accordance with the step of block 34. When playback has stopped, the TTS client requests an attribute change in accordance with the step of block 36 and the TTS engine changes the attribute(s) in accordance with the step of block 38. After the attributes have been changed, the TTS client requests that the text of the next word be loaded and played in accordance with the step of block 40 and the TTS engine starts playback in accordance with the step of block 42, resuming the playback from the next word following the last played word. The stopping, changing and starting happen so quickly that the user is unaware that the playback has been interrupted. In the meantime, the TTS client enters an idle state in accordance with the step of block 44, awaiting either further user input or notifications from the TTS engine.

Figure 2:
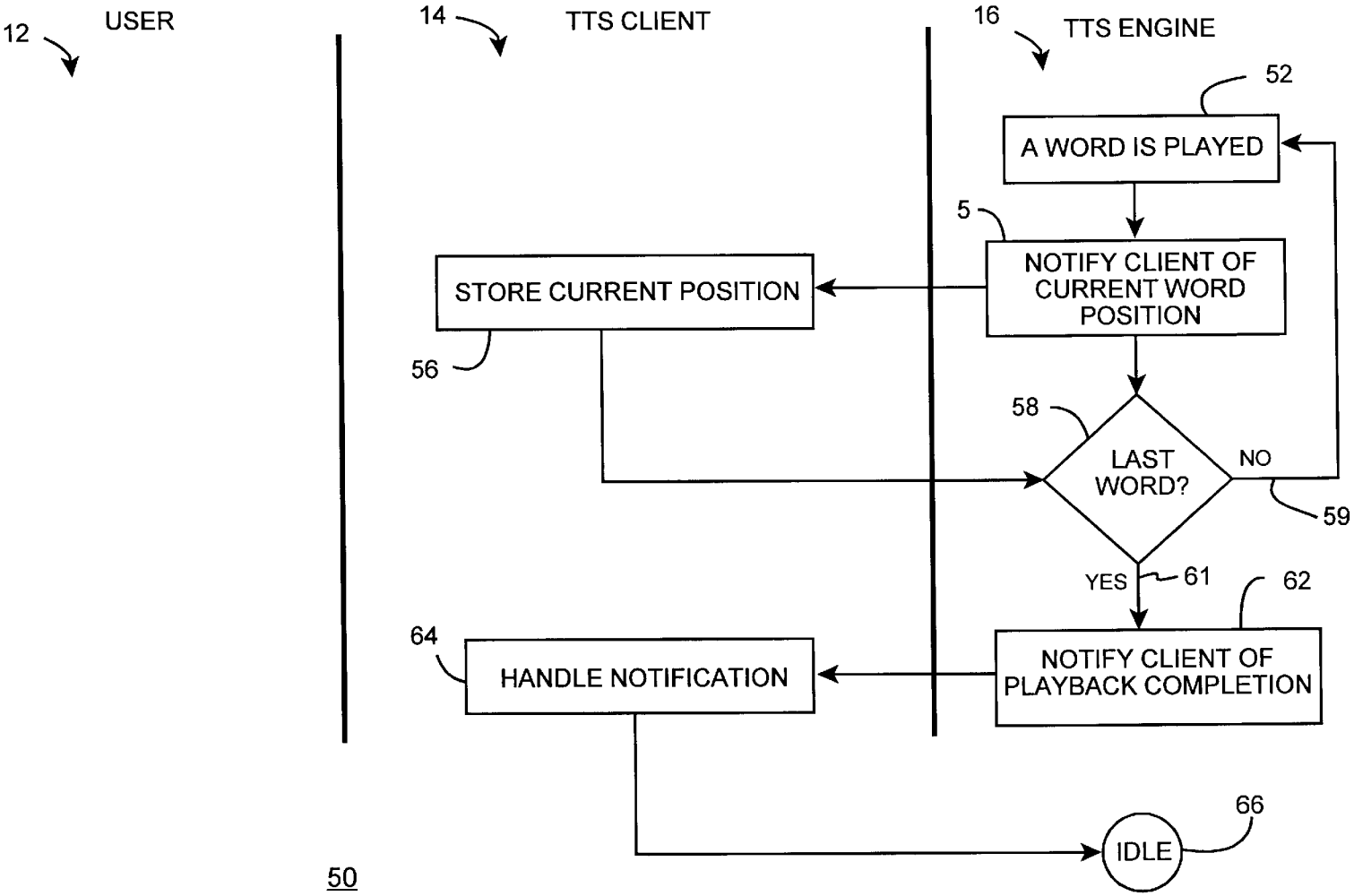
FIG. 2 is a flow chart useful for explaining how the TTS client is notified by the TTS system whenever a word is played or when playback has terminated.

The flow chart 50 in FIG. 2 generally shows how the TTS client is notified by the TTS engine whenever a word is played or when playback has terminated. As in FIG. 1, the flow chart is divided into three different areas 12, 14 and 16 representing the user, the TTS client and the TTS engine respectively. In this case, all of the steps are in the TTS client and TTS engine areas 14 and 16. The TTS system plays a word in accordance with the step of block 52. The TTS system then notifies the TTS client of the current position. This step is calling the function WordPosition, which occurs whenever the TTS engine plays a word.

When WordPosition is called, the TTS engine provides a character or byte oriented offset indicating the position of the word with respect to the beginning of the text string provided to the TTS system by the TTS client. This is the global variable gTTSCurOffset.

The TTS client stores gTTSCurOffset, and thereafter, the TTS engine determines if the last word has been played in accordance with the step of decision block 58. If the last word has not been played, the method branches on path 59 back to the step of block 52 and the TTS engine plays another word. If the last word has been played, the method branches on path 61 to the step of block 62, in accordance with which the TTS client is notified that playback has been completed. This step is calling the function AudioDone.

After notification, the TTS client handles the notification in accordance with the step of block 64. Whenever the TTS client handles WordPosition, the TTS client takes the notification offset, that is gTTSCurOffset, and calculates the actual offset with respect to the original text string provided by the user. The TTS client can then use this actual offset to highlight the currently playing word.

In the meantime, the TTS engine enters an idle state in accordance with the step of block 66, awaiting either further requests from the TTS client.

Prior to calling the Play function the first time, in accordance with the step of block 72, the TTS client stores the text in gText and sets gActualStart to 0, indicating that the TTS engine is to play gText from the beginning. In addition, and at the same time, gCurrentPos and gTTSCurOffset are set to 0 to indicate that the current word is the first word in the text string.

Figure 3:
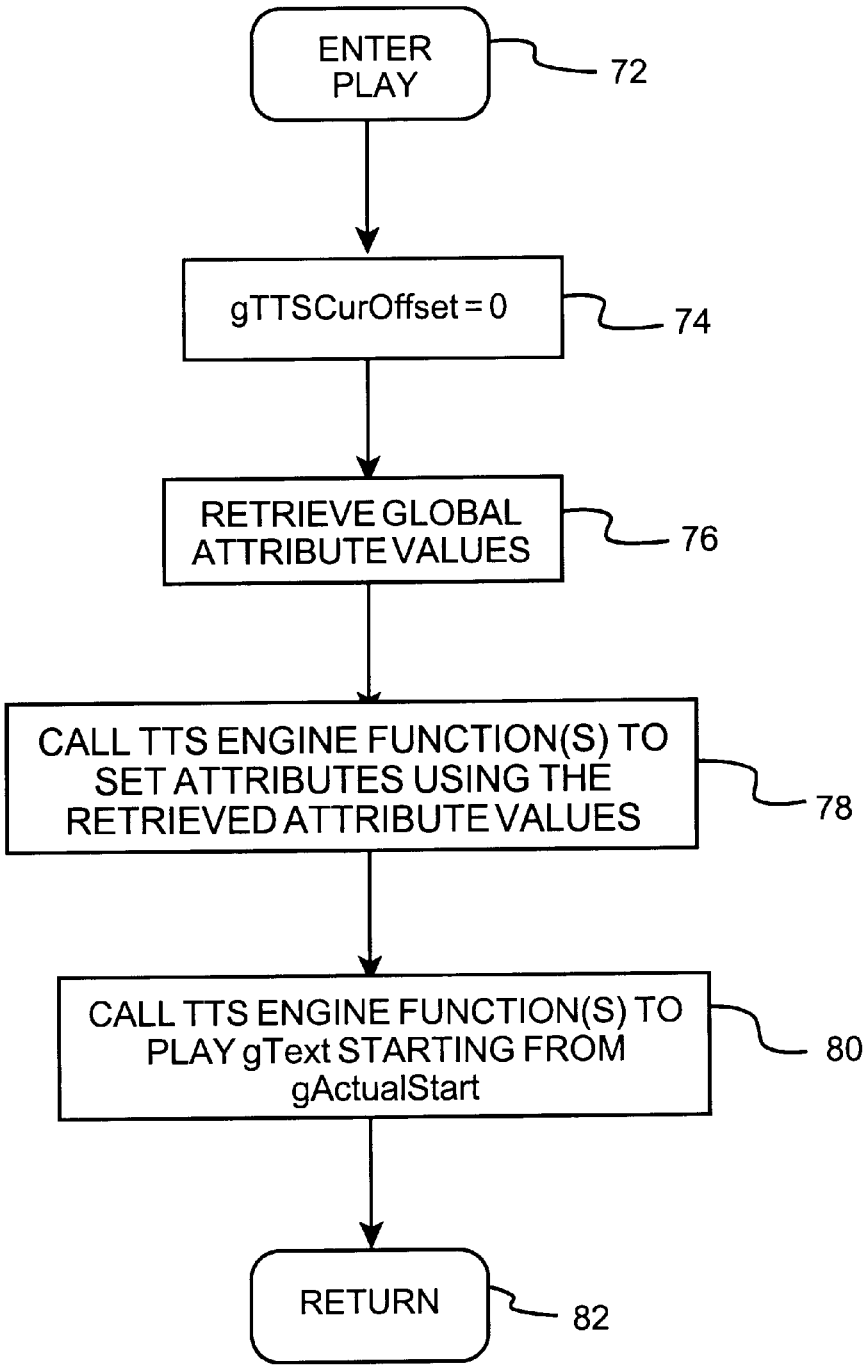
FIG. 3 is a flow chart useful for explaining the Play function.

FIG. 3 is a flow chart 70 showing the Play function. Playback commences when the Play function is called by the TTS client in accordance with the step of block 72. The Play function sets the gTTSCurOffset global variable to 0 to indicate that the current word as played by the TTS engine is the first word in the string, in accordance with the step of block 76. Next, the attribute values are retrieved in accordance with the step of block 76, and thereafter, the necessary TTS functions are called to be set as requested, in accordance with the step of block 78. After the attributes are set, the TTS engine is loaded with the text in accordance with the step of block 80, starting with the offset specified in gActualStart. The TTS function to initiate playback is called. Finally, the method returns to the caller in accordance with the step of block 82.

Figure 4:
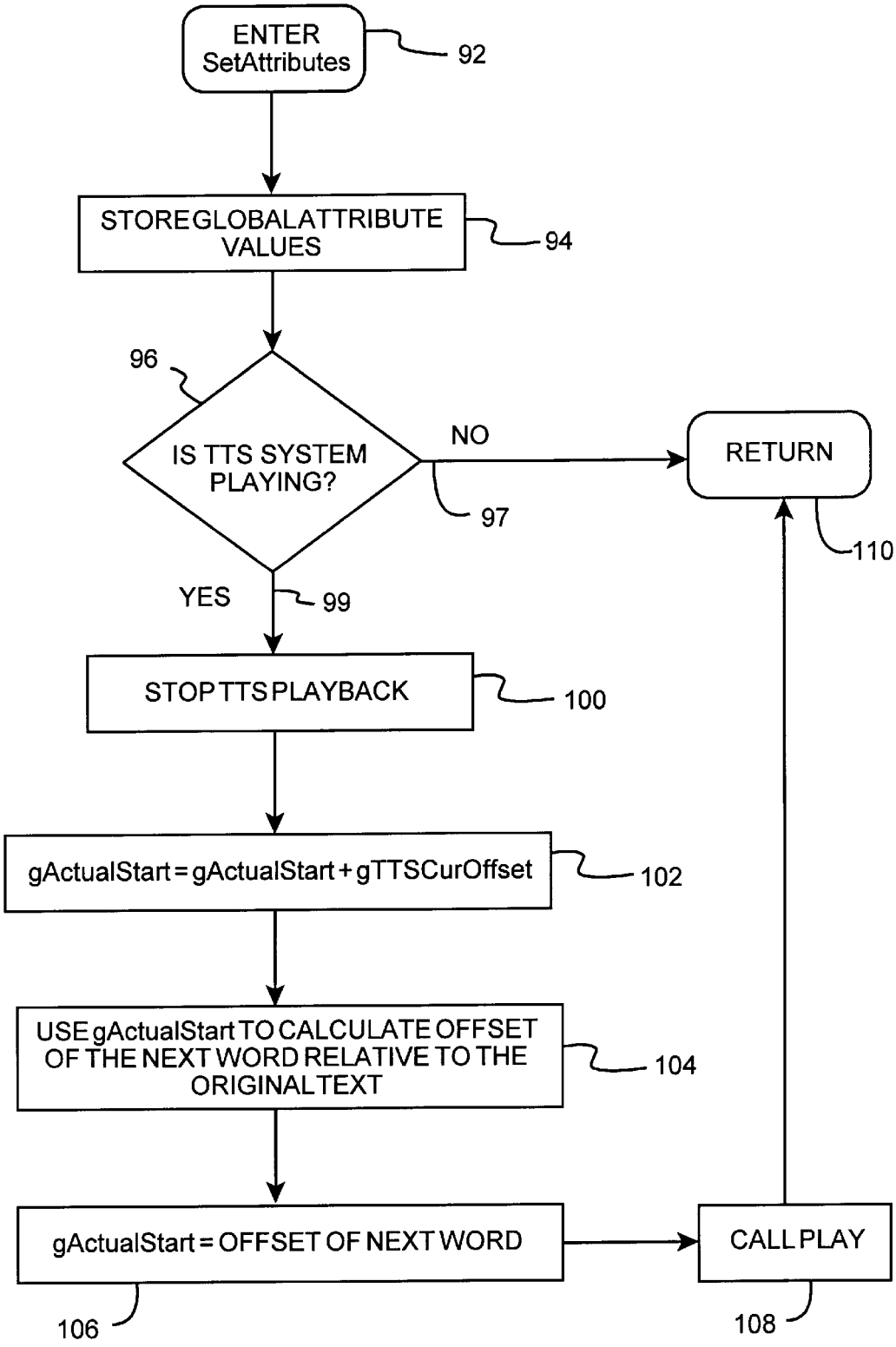
FIG. 4 is a flow chart useful for explaining how the attributes are set.

FIG. 4 shows a flow chart 90 for setting the attributes. The SetAttributes function is entered in accordance with the step of block 92. First, the attributes as specified by the caller are stored in global attribute variables in accordance with the step of block 94. Then, in accordance with the step of decision block 96, a determination is made as to whether the TTS system is currently playing. If not, the method branches on path 97 to the step of block 110, in accordance with which the function simply returns. If so, the method branches on path 99 to the step of block 100, in accordance with which the TTS playback is stopped. After TTS playback is stopped, the latest offset returned by the WordPosition callback is added to the global value gActualStart in accordance with the step of block 102. gActualStart is then used in accordance with the step of block 104 to find the offset of the next word relative to the original text to play. gActualStart is then set to the offset of the next word in accordance with the step of block 106. Thereafter, Play is called in accordance with the step of block 108 and the function finally returns to the caller in accordance with the step of block 110.

The modification of gActualStart within SetAttributes is crucial to maintaining the correct current position relative to the original text as provided by the user. As mentioned before, the SetAttributes function stops any current playback in order to set the TTS attributes. In order to resume playback the SetAttributes calls Play, which uses gActualStart to load the TTS engine with the text starting at the next word. However, when the TTS system subsequently invokes the WordPosition callback, the offset provided is relative to this second, truncated version of the original string. The offset is not with respect to the original string as provided by the user.

Figure 5:
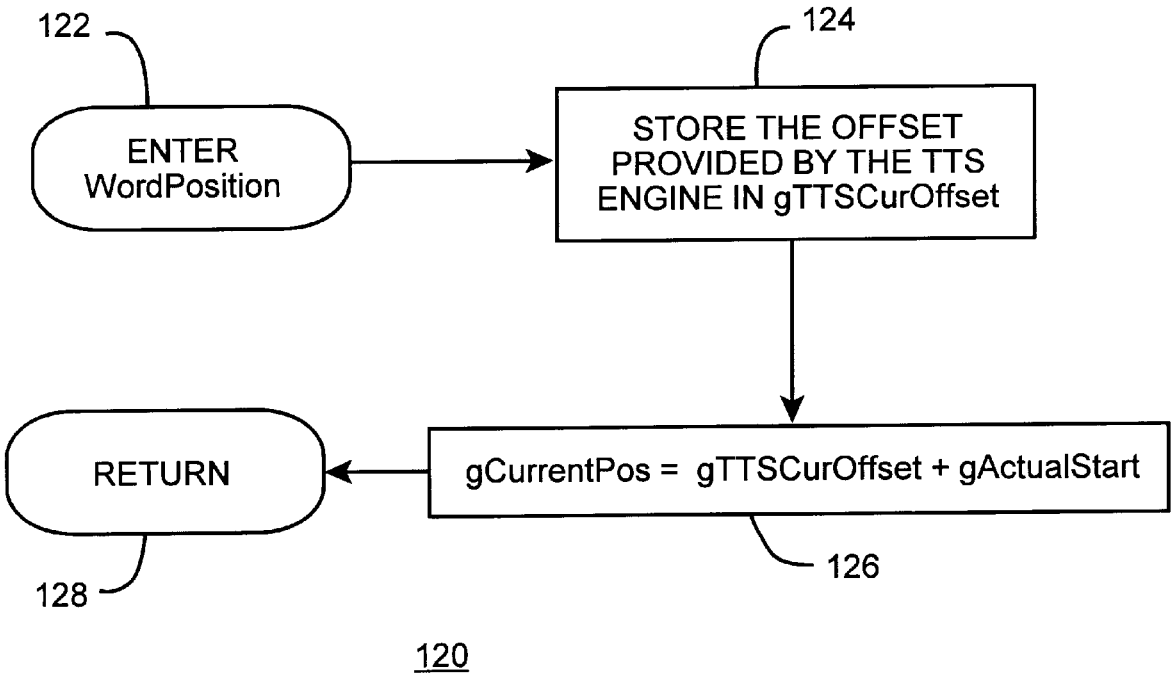
FIG. 5 is a flow chart useful for explaining WordPosition callback.

The current position is calculated by adding the actual starting position to the offset returned in WordPosition, as shown by flow chart 120 in FIG. 5. The WordPosition is entered in accordance with the step of block 122. The offset provided by the TTS engine is stored in gTTSCurOffset in accordance with the step of block 124. gCurrentPos is then set to the sum of gTTSCurOffset and gActualStart in accordance with the step of block 126, after which the function returns in accordance with the step of block 128.

The interaction of the constituent parts of the inventive arrangements as explained in connection with the flow charts in FIGS. 1–5 can be appreciated from the following example. Suppose the user had directed the TTS client to playback the string "Once upon a midnight dreary". Table 2 below shows the starting offsets of each word relative to the beginning of the string. It can be noted that each space between a word counts as one byte towards the offset of the next word.

TABLE 2

| Text | Once | upon | a | midnight | dreary |
|---|---|---|---|---|---|
| Offset | 0 | 5 | 10 | 12 | 21 |

Now, suppose that just as the word "upon" is playing the user changes the speed of the playback, invoking SetAttributes via the TTS client. At this point, the current offset, gCurrentPos, is equal to 5. SetAttributes determines that the TTS system is playing, terminates playback and calls Play, which calls a TTS system function to set the playback speed to the desired value.

Now, to resume playback, Play loads the TTS system with the string "a midnight dreary", since the last word played was "upon", and commences playback. As can be seen in Table 3 below, the TTS engine WordPosition callback now returns an offset of 0 for "a", when previously the TTS engine would have returned a value of 10. The offset changes because the TTS engine only has a record of the last string loaded, and all offsets the TTS engine returns via WordPosition notifications are with respect to that string.

An example of byte offsets for truncated text is illustrated in Table 3.

TABLE 3

| Text | a | midnight | dreary |
|---|---|---|---|
| Offset | 0 | 2 | 11 |

In order to ensure that the TTS client has a current offset relative to "Once upon a midnight dreary", SetAttributes stores the starting offset of the second string with to respect to the first string. In this case, gActualStart is set to 10. As each WordPosition notification occurs, the offset gTTSCurOffset is added to gActualStart to obtain the current offset which is stored in gCurrentPos. For example, when WordPosition is called for "a", gCurrentPos will be set to 10. At this point, gActualStart is 10 and gTTSCurOffset is 0. When called for "midnight", gCurrentPos will be set to 12, because gActualStart is still 10 but gTTSCurOffset is now 2.

The method for adjusting gActualStart is propagated across all subsequent attribute changes. For example, suppose the user now changes the speed just as "midnight" is playing. The actual starting offset gActualStart will be set to 21 because "dreary" is the next word after "midnight".

By maintaining the variables as described above, the TTS client can be assured that the TTS client can use the current position to highlight the correct words as the words are played by the TTS engine, even as the attributes are being set.

In summary, the inventive arrangements advantageously enable a text-to-speech client application to change various TTS attributes such as pitch and speed while playback is in progress. This capability is particularly useful when TTS engines do not allow such dynamic attribute modification, and can be implemented directly in the main body of a client application, or in intermediate code between such a client and a TTS engine.

What is claimed is:

1. In a system external to a TTS engine, a method for dynamically altering text-to-speech (TTS) playback attributes of the TTS engine during playback of specified text in accordance with at least one TTS engine attribute, wherein the TTS engine is not inherently capable of dynamic attribute alteration, comprising the steps of:

representing in said external system a resettable start word position value by a first variable, said resettable start word position indicating a starting offset of said specified text currently loaded in said TTS engine;

representing in said external system a current word position value by a second variable, said current word position value indicating an offset relative to said resettable start word position;

updating in said external system said second variable each time a word of said specified text is played back;

stopping said TTS playback of said TTS engine in response to a user request to alter said at least one TTS attribute;

after stopping said TTS playback, altering said at least one TTS engine attribute;

also after stopping said TTS playback, replacing in said external system said first variable with a new start word position value corresponding to the next successive unplayed word of said specified text; and, restarting playback of said text in accordance with said new word start position value, said next successive unplayed word being played back by said TTS engine.

2. The method of claim 1, further comprising the step of resetting said second variable to zero after replacing said first variable with said new start word position value corresponding to said next successive unplayed word of said specified text.

3. The method of claim 2, wherein said step of replacing said first variable comprises the steps of:

replacing said first variable with a sum of said first and second variables; and, using said replaced first variable to determine said new start word position value.

4. The method of claim 1, wherein said step of replacing said first variable comprises the steps of:

replacing said first variable with a sum of said first and second variables; and, using said replaced first variable to determine said new start word position value.

5. The method of claim 1, wherein after said stopping step, said altering step begins prior to said replacing step.

6. The method of claim 1, wherein after said stopping step, said replacing step begins prior to said altering step.

7. The method of claim 1, wherein after said stopping step, said altering step and said replacing step are time coincident.

8. The method of claim 1, comprising the step of stopping said TTS engine playback only between words of said specified text.

9. The method of claim 1, further comprising the step of representing a current word position in said specified text by a sum of said first and second variables.

10. The method of claim 1, further comprising the steps of:

receiving said user request in a TTS client;

transmitting a request to stop said playback from said TTS client to said TTS engine;

transmitting a notice from said TTS engine to said TTS client that said playback has stopped;

transmitting a request to alter said at least one TTS engine attribute from said TTS client to said TTS engine;

transmitting a notice from said TTS engine to said TTS client that said at least one TTS engine attribute has been altered;

sending a text string from said TTS client to said TTS engine beginning with said next successive unplayed word; and, playing back said text string beginning with said next successive unplayed word.

* * * * *